US010293633B2

(12) United States Patent
Hoffman

(10) Patent No.: US 10,293,633 B2
(45) Date of Patent: May 21, 2019

(54) WRITING INSTRUMENT THAT REDUCES IMPACT OF ATTENTION DEFICIT DISORDERS

(71) Applicant: Lee Hoffman, Morton, IL (US)

(72) Inventor: Lee Hoffman, Morton, IL (US)

( * ) Notice: Subject to any disclaimer, the term of this patent is extended or adjusted under 35 U.S.C. 154(b) by 0 days.

(21) Appl. No.: 15/530,023

(22) Filed: Nov. 22, 2016

(65) Prior Publication Data

US 2017/0136805 A1 May 18, 2017

Related U.S. Application Data

(60) Provisional application No. 62/256,928, filed on Nov. 18, 2015.

(51) Int. Cl.

| | |
|---|---|
| ***B43K 29/00*** | (2006.01) |
| ***B43K 7/00*** | (2006.01) |
| ***B43K 19/02*** | (2006.01) |

(52) U.S. Cl.

CPC ..... *B43K 29/00* (2013.01); *B43K 7/005* (2013.01); *B43K 19/02* (2013.01); *B43K 29/005* (2013.01)

(58) Field of Classification Search

CPC .... B43K 29/00; B43K 29/003; B43K 29/004; B43K 29/005; B43K 29/10

USPC ..... 401/195

See application file for complete search history.

(56) References Cited

U.S. PATENT DOCUMENTS

| | | | | |
|---|---|---|---|---|
| 1,950,960 | A * | 3/1934 | Wisser | B43K 29/001 33/27.02 |
| 5,281,039 | A * | 1/1994 | Hsiung | A63F 7/042 273/113 |
| 5,951,184 | A * | 9/1999 | Sanchez | B43K 29/20 401/34 |
| 6,200,046 | B1 * | 3/2001 | Rylander | B43K 23/08 401/195 |
| 6,428,179 | B1 * | 8/2002 | Saffron | B43K 29/10 362/118 |
| 6,948,872 | B2 * | 9/2005 | Eisele | B43K 7/005 401/195 |
| 7,131,785 | B1 * | 11/2006 | Mansouri | A23G 3/50 401/195 |

(Continued)

OTHER PUBLICATIONS

HelpGuide.Org, "Adult ADD / ADHD: Signs, Symptoms, Effects, and Treatment," retrieved at: http://www.helpguide.org/articles/add-adhd/adult-adhd-attention-deficit-disorder.htm, printed Jun. 24, 2015.

(Continued)

*Primary Examiner* — Jennifer C Chiang

(57) ABSTRACT

A writing instrument that comprises a writing instrument base and a focus tool is provided. The writing instrument base includes a marking system coupled with a barrel. The marking system is configured to provide writings on a writing medium, such as paper. The focus tool is coupled with the writing instrument base. The focus tool is configured to blend in with the writing base. The focus tool includes a device that engages a user's senses and reduces the negative impact of attention deficit disorders when used by the user. The fidget tool stimulates the user's vestibular system and proprioceptive senses through one or more of the following: movement, sound, smell, visual, and tactile action. The fidget tool may be discreet such that the tool is hidden or not viewable when not in use.

12 Claims, 15 Drawing Sheets

(56) References Cited

U.S. PATENT DOCUMENTS

| | | | | |
|---|---|---|---|---|
| 8,358,215 | B2 * | 1/2013 | Asad | A61B 5/11 340/573.1 |
| 8,757,911 | B2 * | 6/2014 | Shim | G09B 19/00 401/48 |
| 9,211,757 | B2 * | 12/2015 | Osborne | B43K 23/001 |
| 2005/0095054 | A1 * | 5/2005 | Canale | B43K 5/005 401/195 |
| 2015/0023718 | A1 * | 1/2015 | Gardner | B43K 8/003 401/195 |

OTHER PUBLICATIONS

"Fidgeting May Benefit Children with ADHD," The New York Times, retrieved at: http://well.blogs.nytimes.com/2015/06/24/fidgeting-may-benefit-children-with-a-d-h-d, printed Jun. 24, 2015.

Hallowell, Edward, "Overloaded Circuits: Why Smart People Underperform," Harvard Business Review, Jan. 2005 issue.

Marner, Kay, "Fidgets to Help ADHD Kids Focus at School," ADHD Parenting Blog, ADDitude Magazine, retrieved at: http://www.additudemag.com/adhdblogs/4/6606.html, printed Jun. 24, 2015.

* cited by examiner

WRITING INSTRUMENT THAT REDUCES IMPACT OF ATTENTION DEFICIT DISORDERS

BACKGROUND

The present embodiments relate to a writing instrument that reduces the negative impacts of attention deficit disorders, such as Attention Deficit Trait (ADT), Attention Deficit Disorder (ADD) and Attention Deficit Hyper Disorder (ADHD).

Attention deficit disorders impact millions of children and adults. For many children, these disorders may negatively impact their academics or ability to learn. Past studies had suggested that children with ADHD concentrate better and improve academically if they are physically active during the school day. But that research had focused primarily on how to re-channel the children's hyperactivity. However, more recently, studies have found that the more intensely a child with ADHD wiggled and fidgeted—e.g., the more ferociously they bobbled their legs—the more accurate their answers were on academic tests. When these children were relatively still, their responses were much more likely to be wrong, indicating that they had had trouble concentrating then.

Likewise, for many adults, individuals with these disorders may have difficulty concentrating or staying focused in a meeting or conference—e.g., at work or during a hobby. Fidgeting during these meetings or conferences may likewise help these adults to reduce the impact of these disorders and improve their focus and performance.

However, in many instances (e.g., school or work) fidgeting may be distracting or annoying for those around these individuals. Furthermore, at present, there may be stereotypes that follow children or adults with either of these disorders, such as not being able to perform as well as others without these disorders or being less professional or mature as those without these disorders.

Therefore, there is a need for a fidgeting tool that is discreet and/or socially acceptable.

DESCRIPTION

In an embodiment, a writing instrument includes a focus tool. The focus tool may include a fidget tool. The fidget tool may be configured in a way that is not a distraction to others and also has a level of discreetness in order to not bring unwanted attention to the user.

The fidget tool may include texture material (like Velcro or wood ridges or metal divots), pliable material (memory foam, rubber coated metal), chewable material (hard plastic material), a component that moves (e.g., spins), a resistance component (e.g., a spring to pull or push), manipulative component (e.g., like a nut on a bolt or a ring that slides up and down a shaft). The fidget tool may be used to wiggle and/or fidget.

The fidget tool may be non-distracting. For example, the fidget tool may be silent when in use—for example, without any clicking or snapping or audible noise. As such, when in use, the fidget tool may not distract those around them with audible noises.

The fidget tool may be discreet. For example, when not in use, the fidget tool may be completely covered in a way that makes the writing instrument visually appear to not have a fidget tool. In some embodiments, a fidget tool cap or sleeve may be used cover the fidget tool. In other embodiments, the fidget tool may be recessed or enclosed inside of the writing instrument, such that it may not be seen when looking at the writing instrument.

The focus tool may be used to allow a user to fidget or stimulate the various senses (e.g., touch or smell). In turn, this stimulation may reduce the impacts of attention deficit disorders, such as ADD or ADHD or ADT. Because the focus tool is part of the writing instrument, the user may carry it along, for example, during school, meetings, and conferences without drawing unwanted attention to them, increasing the stereotype, or hindering the people around them.

i. Example of a Writing Instrument with a Focus Tool

Figure 1:
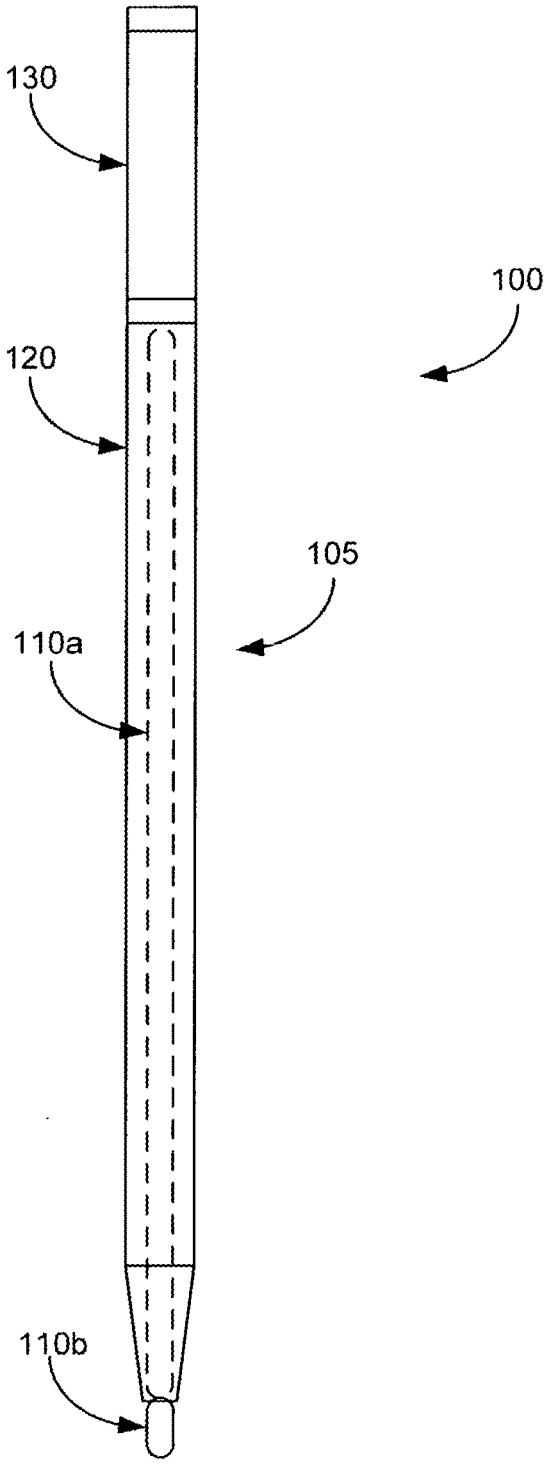
FIG. 1 illustrates an exemplary embodiment of a writing instrument with focus tool.

FIG. 1 illustrates an example embodiment of a writing instrument 100 that includes a writing instrument base 105 and a focus tool 130. In an embodiment, the writing instrument base 105 may be coupled with the focus tool 130. As used herein, "coupled with" may include directly or indirectly connected with intermediary components. Additional, different, or fewer components may be provided. For example, the writing instrument may include an eraser, cap, or other components provided with writing instruments.

The writing instrument 100 may be, for example, a pen, pencil, marker, stylus, or other instrument that provides markings or writings. In an embodiment, the writing instrument is a pen. A pen is a writing implement used to apply ink to a surface, usually paper, for writing or drawing. Historically, reed pens, quill pens, and dip pens were used, with a nib dipped in ink. Modern types also include ballpoint, rollerball, fountain, and felt or ceramic tip pens. A ballpoint pen dispenses ink by rolling a small hard sphere, usually 0.7-1.2 mm and made of brass, steel or tungsten carbide. The ink dries almost immediately on contact with paper. The ballpoint pen is usually reliable and come in both inexpensive and expensive types. It has replaced the fountain pen as the most common tool for everyday writing. A fountain pen uses water-based liquid ink delivered through a nib. The ink flows from a reservoir through a "feed" to the nib, then through the nib, due to capillary action and gravity. The nib has no moving parts and delivers ink through a thin slit to the writing surface. A fountain pen reservoir can be refillable or disposable, this disposable type being an ink cartridge. A pen with a refillable reservoir may have a mechanism, such as a piston, to draw ink from a bottle through the nib, or it may require refilling with an eyedropper. Refill reservoirs, also known as cartridge converters, are available for some pens which use disposable cartridges. A rollerball pen dispenses a water-based liquid or gel ink through a ball tip similar to that of a ballpoint pen. The less-viscous ink is more easily absorbed by paper than oil-based ink, and the pen moves more easily across a writing surface. The rollerball pen was initially designed to combine the convenience of a ballpoint pen with the smooth "wet ink" effect of a fountain pen. Gel inks are available in a range of colors, including metallic paint colors, glitter effects, neon, blurred effects, saturated colors, pastel tones, vibrant shades, shady colors, invisible ink, see-through effect, shiny colors, and glow-in-the-dark effects.

In an embodiment, the writing instrument 100 is a pencil. A pencil is a writing implement or art medium usually constructed of a narrow, solid pigment core inside a protective casing which prevents the core from being broken or leaving marks on the user's hand during use. Pencils create marks by physical abrasion, leaving behind a trail of solid core material that adheres to a sheet of paper or other surface. They are distinct from pens, which instead disperse a trail of liquid or gel ink that stains the light color of the paper. Most pencil cores are made of graphite mixed with a clay binder which leaves grey or black marks that can be easily erased. Graphite pencils are used for both writing and drawing and result in durable markings: though writing is easily removable with an eraser, it is otherwise resistant to moisture, most chemicals, ultraviolet radiation, and natural aging. Other types of pencil core are less widely used, such as charcoal pencils, which are mainly used by artists for drawing and sketching. Colored pencils are sometimes used by teachers or editors to correct submitted texts, but are typically regarded as art supplies, especially those with waxy core binders that tend to smear on paper instead of erasing. Grease pencils have a softer, crayon-like waxy core that can leave marks on smooth surfaces such as glass or porcelain. The most common type of pencil casing is of thin wood, usually hexagonal in section but sometimes cylindrical, permanently bonded to the core. Similar permanent casings may be constructed of other materials such as plastic or paper. To use the pencil, the casing must be carved or peeled off to expose the working end of the core as a sharp point. Mechanical pencils have more elaborate casings which support mobile pieces of pigment core that can be extended or retracted through the casing tip as needed.

In an embodiment, the writing instrument 100 is a marker. A marker, or felt-tip pen, has a porous tip of fibrous material. The smallest, finest-tipped markers are used for writing on paper. Medium-tip markers are often used by children for coloring and drawing. Larger markers are used for writing on other surfaces such as corrugated boxes, whiteboards and for chalkboards, often called "liquid chalk" or "chalkboard markers." Markers with wide tips and bright but transparent ink, called highlighters, are used to mark existing text. Markers designed for children or for temporary writing (as with a whiteboard or overhead projector) typically use non-permanent inks. Large markers used to label shipping cases or other packages are usually permanent markers.

In an embodiment, the writing instrument base 105 may include a marking system 110 and barrel 120. In an embodiment, the marking system 110 may be coupled with the barrel 120. As used herein, "coupled with" may include directly or indirectly connected with intermediary components. Additional, different, or fewer components may be provided. For example, the writing instrument may include an eraser, cap, or other components provided with writing instruments. In another example, the writing instrument may not include the marking system 110.

The marking system 110 may be a system that provides (e.g., leaves) markings or writings on a writing medium, such as paper, white board, and cardboard. The marking system 110 may include a marking material **110*a* and a marking enclosure 110*b***.

In an embodiment, the marking material **110*a* may include graphite, ink, paint, or other composition that leaves writings or markings on a writing medium. The marking material 110*a* and marking enclosure 110*b* may depend on the type of writing instrument 100 is provided. For example, as discussed above, the writing instrument 100 may be a pen. Accordingly, the marking material 110*a* may be ink and the marking enclosure 110*b* may be a reservoir and nib, such that the ink flows from a reservoir through a feed to the nib, then through the nib, due to capillary action and gravity. The nib has no moving parts and delivers ink through a thin slit to the writing surface. In another example, the writing instrument 100 may be a pencil. Accordingly, the marking material 110*a* may be graphite and the marking enclosure 110*b* may be the barrel 120 that is made of wood, such that the graphite is enclosed inside the wood and is protected from being broken. The wood may be shaved down and exposing the graphite. In yet another example, the writing instrument 100 is a marker. Accordingly, the marking material 110*a*** may be paint and stored inside a reservoir that dispenses the paint through a felt tip.

The marking system 110 may include additional, different, or fewer components.

The barrel 120 may be designed, configured, molded, formed, or otherwise structured based on the type of writing instrument. For example, the barrel of a pen may be made of plastic and form an enclosure that allows the marking system 110 to be housed inside. In another example, the barrel of a pencil may be made of wood and completely enclose the marking system 110.

The focus tool 130 may be a system that is designed to reduce the negative impact of the attention deficit disorders and minimize the attention drawn to the focus tool. The focus tool 130 may be configured in a way that blends in with the remainder of the writing instrument. As young children mature into adolescences and eventually adults, the social stigma associated with relying on fidget devices increases. Unfortunately, the impact of attention deficit disorders still impacts adults, and there are few, if any, socially acceptable toys/tools for adults dealing with the effects of attention deficit. This focus tool will allow the ability to fidget, which increases cognitive concentration and attention, while at the same time being discreet to not create a negative perception by others in proximity. The focus tool with research-based fidgets is attached to a writing device because in most settings it is already socially acceptable for adults to play with/fidget with a writing instrument during business and social situations.

In an embodiment, the focus tool 130 may be embedded with the barrel 120. "Embedded with" may include "integrated with," "manufactured with or into," "connected to," or otherwise incorporating. The focus tool 130 and the barrel 120 may be made of the same material and/or have the same color. For example, the focus tool may be manufactured into the barrel of a wooden pencil.

In an embodiment, the focus tool 130 may be separate from the barrel 120. The focus tool 130 may be removable from the barrel 120 or attached.

The focus tool 130 may be used to repeatedly engage the user's senses. ADD/ADHD affects the regions of the brain, namely the prefrontal cortex, which are concentrated areas for control, planning, and memory and execution functions. Research has proven that the ADD brain has normal activity during times of rest but has decreased activity when doing tasks that require concentration (research by Dr. Daniel Amen). During these times of decreased activity, the brain seeks to be stimulated, and subsequently the ADD/ADHD brain is distracted by other stimuli. One method people with ADD self-regulate this cognitive under-arousal is through stimulation of the vestibular system and proprioceptive sense, which is the position and movement that produce cognitive stimuli, which is commonly known as fidgeting. This fidgeting is a sensory-motor action that helps the ADD brain regulate the activity in the prefrontal cortex during these times of under-stimulation or under-arousal. The fidgeting actions stimulate the brain and allow the ADD brain to concentrate on the desired stimulus. The impact of fidgeting on the brain is sometimes referred to as embodied cognition.

In an embodiment, the focus tool 130 may include one or more fidget devices. A fidget tool may be a device or system that engages a user's senses. The fidget tool may be movable or non-movable. For example, the focus tool may include texture (for example, Velcro or ridges), resistance (for example, a spring to pull or push), pliable material (for example, memory foam, rubber coated metal), chewable material (for example, hard plastic material) and/or a system where one or more of the components may be manipulative (for example, a nut on a bolt or a washer that slides up and down a shaft).

The fidget tool may provide one or more fidget strategies that stimulate the vestibular system and proprioceptive sense through movement, sound, smell, visual, and tactile action.

In an embodiment, the focus tool may house one or more fidget devices that may include magnetic properties that can be disconnected from the fidget tool. The user can discreetly with the hand fidget with these disconnected devices (e.g., two solid metal cylinders) and then reattach them to the fidget tool when finished.

In an embodiment, the focus tool may include a resistance spring that connects two parts of the focus tool to provide a muscular tension by either pushing or pulling the two connected pieces. This resistance spring also allows the focus tool to flex from side to side when pressure is applied.

In an embodiment, the focus tool may include a water bubble that refracts light housed inside a capsule in the focus tool. This bubble will move when turning the focus tool in relation to gravity.

In an embodiment, the focus tool may include sand inside a capsule housed in the focus tool that can be flipped so gravity moves the sand inside the capsule.

In an embodiment, the focus tool may include lighted indicators that brighten in relation to a designated, programmed timeframe to enhance the organizational support needed to complete tasks. These lights may be designed as small circles or bands on the focus tool.

In an embodiment, the focus tool may include an extremely firm but pliable shaft that can be manipulated and shaped by the hands.

In an embodiment, the focus tool may include a spinning disc at the end of the focus tool that can be pulled out and silently spun around its axis. The spinning disc can then be slid back into place to keep from moving when not desired.

In an embodiment, the focus tool may include a spinning rod at the end of the focus tool that can be pulled out and silently spun around its axis. The spinning rod can then be slid back into place to keep from moving when not desired.

In an embodiment, the focus tool may include a ring-like component around the shaft of the focus tool that can be twisted. As it is twisted it has an internal click that will be felt by the fingers but not heard audibly.

In an embodiment, the focus tool may include one end unevenly weighted compared to the rest of the writing instrument and will consequently require additional muscular activity to balance in the hand. This muscular tension will create the necessary multiple sensations that will increase focus.

In an embodiment, the focus tool may include firm memory foam embedded into the focus tool that can be pressed and molded with the fingers.

In an embodiment, the focus tool may include horizontal or vertical ridges on the focus tool that create a sensation when the thumb and forefinger are moved along them. The horizontal ridges are felt when the writing instrument is twisted while fingers are resting on the ridges, and the vertical ridges are felt when the writing instrument is pulled through the grasp of the thumb and forefinger.

In an embodiment, the focus tool may include one or more small pyramid structures that line the shaft of the focus tool and will create an uneven but constant texture to either move fingers along or press to create pressure on the fingers or palm.

In an embodiment, the focus tool may include smart technology added to the writing instrument that records meetings and helps with organizational support.

In an embodiment, the focus tool may include a rubber tip on the end that allows the pen to be dropped from a short distance and bounced back into the grasp of the hand. The rubber tip will create the action without creating a distracting noise for others in close proximity.

In an embodiment, the focus tool may include a plastic-like tip that can be safely chewed. Persons with ADD/ADHD will often chew on writing instruments and consequently ruin them. This chewable tip will be more durable than traditional plastic writing instruments.

In an embodiment, the focus tool may include a ring-like component around the shaft of the focus tool that can be twisted. As it is twisted, it moves up and down the shaft of the focus tool.

In an embodiment, the focus tool may include a semicircle indention in the side of the focus tool so that the writing instrument can be balanced on a finger or edge of the hand. The gravitational pull and muscle activity needed to balance the writing instrument will focus the brain.

In an embodiment, the focus tool may include a mechanical screw at the end of the focus tool that can be twisted out and rotated back into the focus tool.

In an embodiment, the focus tool may include a capsule that is attached to the end of the focus tool that may have different subtle smells only detectable when placed near the nose.

In an embodiment, the focus tool may include a round object (for example a ball) housed inside the focus tool that may move back and forth by gravity or the fingers. For example, the round object may be held in place by rods that allow the round object to be manipulated by the fingers. In another embodiment, the round object may be held in place by a barrel with rubber tips at the end of the barrel such that when the ball hits the ends, there is no noise or bounces back, which provides more sensation.

In an embodiment, the focus tool may include a soft rubber lining around a portion of the focus tool that can be squeezed, which increases the proprioceptive sense.

ii. Exemplary Embodiments of a Fidget Tool

Figure 2:
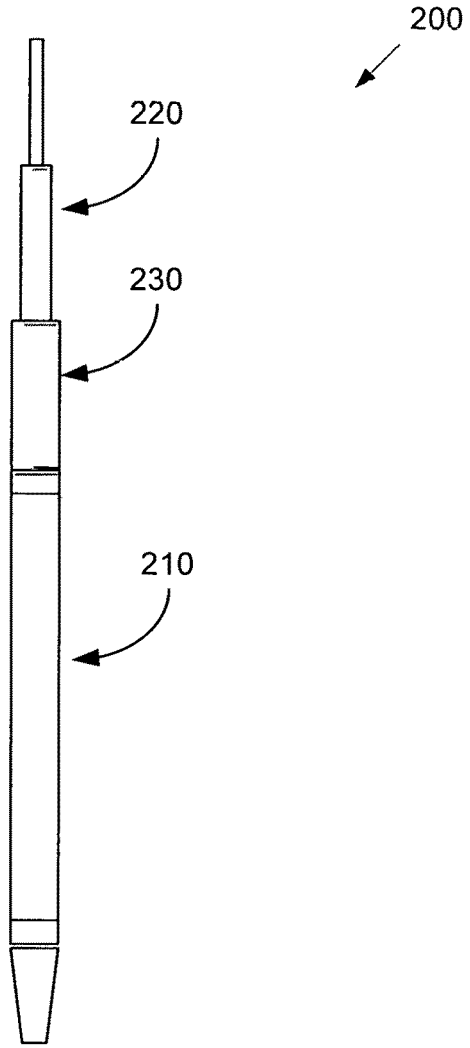
FIG. 2 illustrates an exemplary embodiment of a stair-step fidget tool.

FIG. 2 illustrates an example embodiment of a writing instrument 200 including a writing instrument base 210 and focus tool 220. The writing instrument 200 may be the same and/or similar to the writing instrument 100 of FIG. 1. For example, the description provided above for the writing instrument 100 may be incorporated herein for writing instrument 200. Additional, different, or fewer components may be provided.

The focus tool 220 may include a stair-step fidget tool 230. The stair-step fidget tool 230 may resemble the steps in a stairway, for example, the design moving up or down like steps in a stairway. The stair-step design will allow a user to push or pull the fingers over the ridges of the stair-step design. This physical movement coupled with the sensation of the fingers hitting the ridges will engage a secondary sense, which research has proven will benefit the cognitive activity needed to focus on the desired primary sense/activity.

Figure 3:
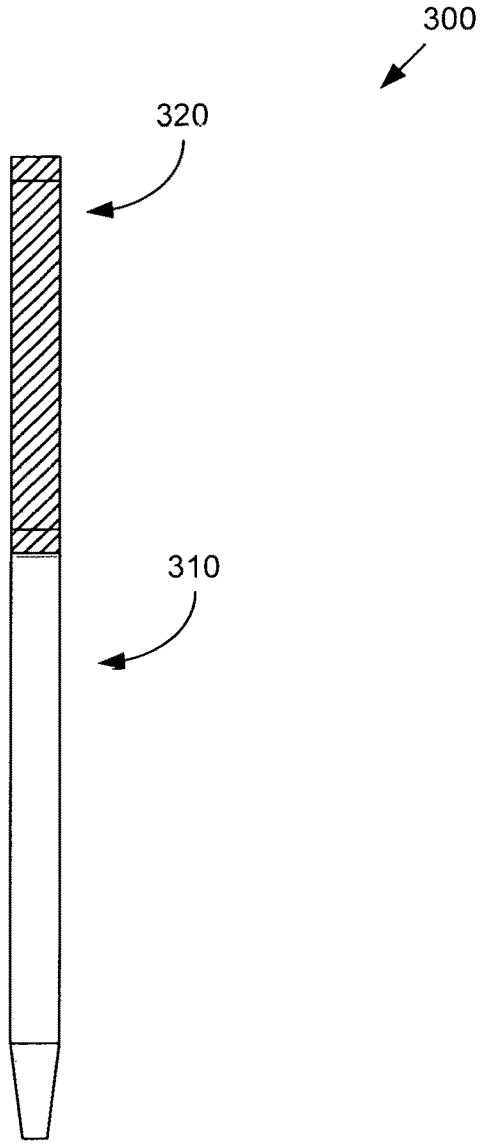
FIG. 3 illustrates an exemplary embodiment of a memory foam fidget tool.

FIG. 3 illustrates an example embodiment of a writing instrument 300 including a writing instrument base 310 and focus tool 320. The writing instrument 300 may be the same and/or similar to any of the writing instruments described herein. For example, the description provided above for the writing instrument 100 may be incorporated herein for writing instrument 300. Additional, different, or fewer components may be provided.

The focus tool 320 may include a memory foam fidget tool 230. The memory foam fidget tool 230 may include memory foam, for example, surrounding a shaft of the focus tool 320. The memory foam may allow a user to squeeze and manipulate the foam. The organic nature of the memory foam fidget tool 230 creates continuous variation for the user. The foam can be manipulated in various forms and shapes or shaped in a repetitive manner. For some ADD/ADHD brains, variation is required for sustained cognitive engagement with a fidget. This memory foam provides that capability.

Figure 4:
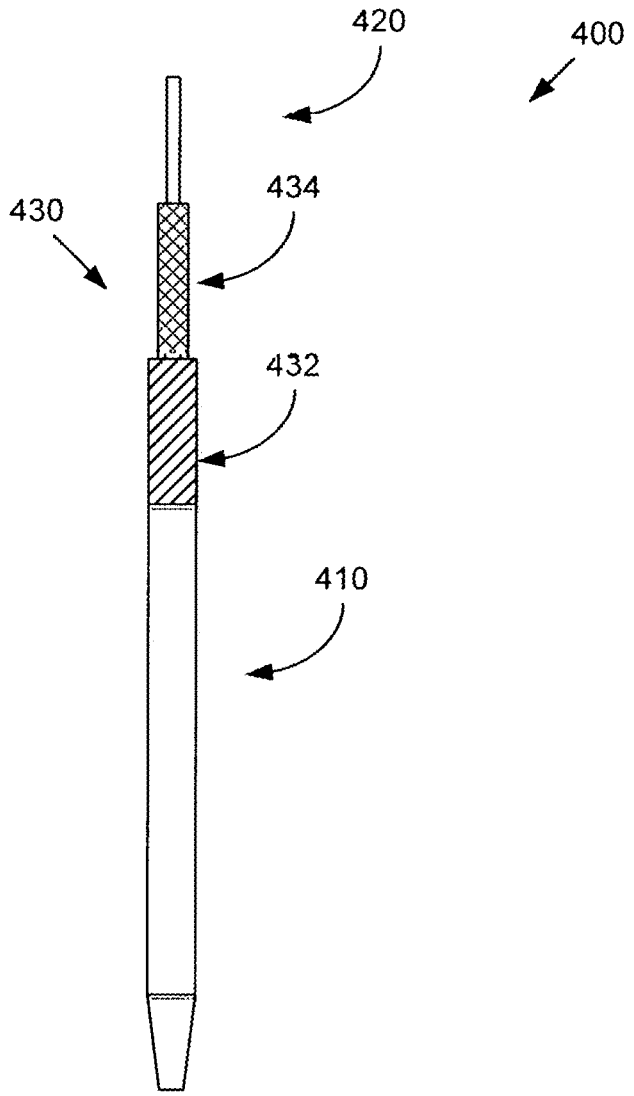
FIG. 4 illustrates an exemplary embodiment of a fidget tool with stair-step, memory foam, and adhesive fidget devices.

FIG. 4 illustrates an example embodiment of a writing instrument 400 including a writing instrument base 410 and focus tool 420. The writing instrument 300 may be the same and/or similar to any of the writing instruments described herein. For example, all or some of the description provided above for the writing instrument 100 may be incorporated herein for writing instrument 400. Additional, different, or fewer components may be provided.

The focus tool 420 may include a combination of a stair-step fidget tool 430 and fidget material, such as memory foam 432 and adhesive 434. The stair-step fidget tool 430 may resemble the steps in a stairway, for example, the design moving up or down like steps in a stairway. The stair-step design will allow a user to rub their finger over the stair-steps 430. Additionally, each step of the stair-step fidget tool 430 may include the same or different material. For example, the stair-step 432 may include memory foam. The stair-step 434 may include an adhesive (sticky side of tape) that is sticky, which allows the user to pinch the step 434 and then pull their fingers off. The combination of the fidget devices (e.g., stair steps and different materials) allows the user different options. Once again, for some ADD/ADHD brains, variation is required for sustained cognitive engagement with a fidget. The varied textures on this focus tool will provide multiple tactile stimuli.

Figure 5:
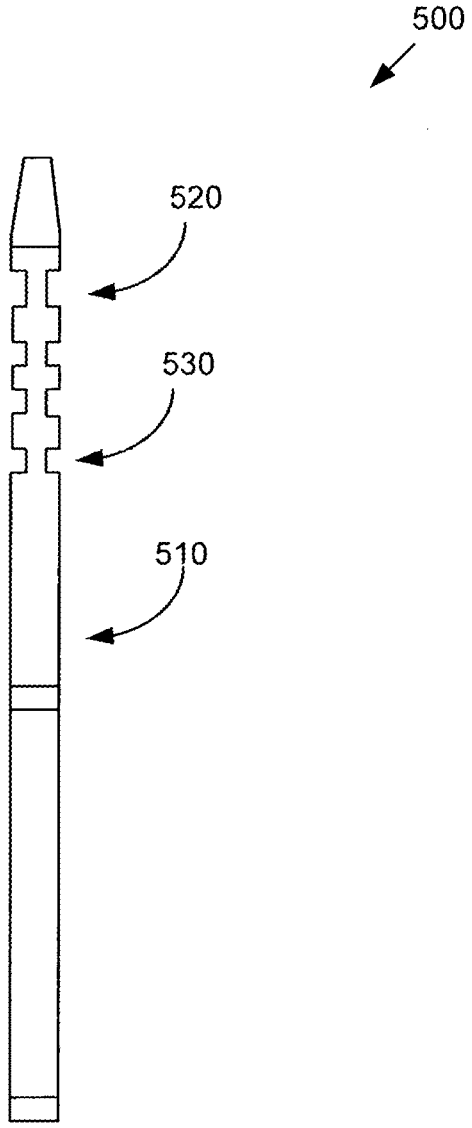
FIG. 5 illustrates an exemplary embodiment of a ridged focus tool.

FIG. 5 illustrates an example embodiment of a writing instrument 500 including a writing instrument base 510 and focus tool 520. The writing instrument 500 may be the same and/or similar to any of the writing instruments described herein. For example, the description provided above for the writing instrument 100 may be incorporated herein for writing instrument 500. Additional, different, or fewer components may be provided.

The focus tool 520 may include one or more ridges 530. The ridges may be built into the writing instrument base 510. Touch strategies that help with ADD/ADHD are more effective with a combination of movement and tactile or textural stimulation, e.g., the twirling of hair or fiddling with jewelry. The strategic design of the ridges 530 allows the user to discreetly create this movement and textural stimulation with the fingers or other parts of the hand.

Figure 6:
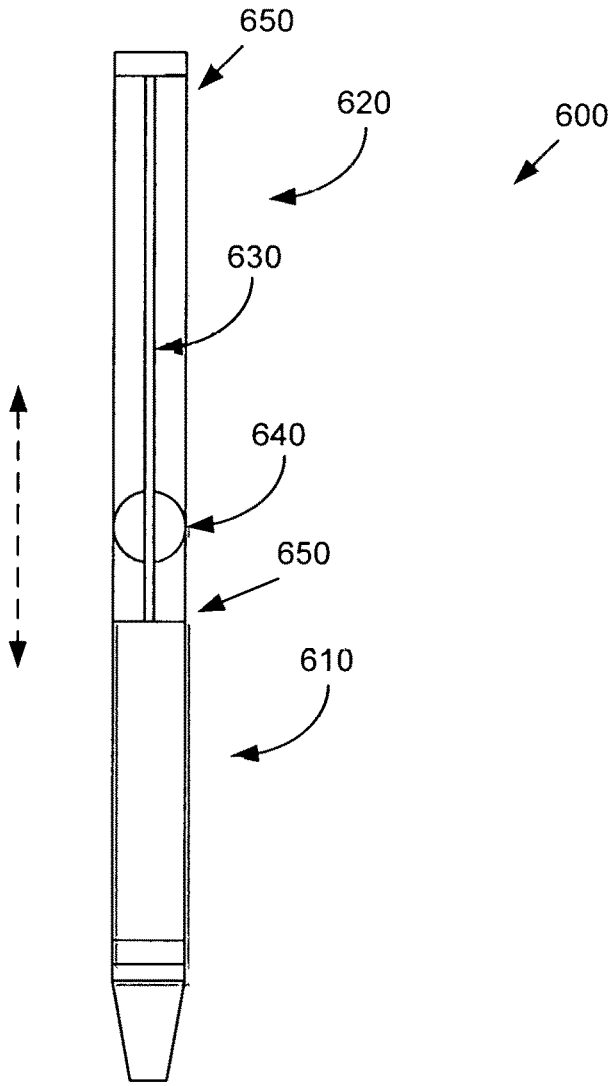
FIG. 6 illustrates an exemplary embodiment of a ball and track focus tool.

FIG. 6 illustrates an example embodiment of a writing instrument 600 including a writing instrument base 610 and focus tool 620. The writing instrument 600 may be the same and/or similar to any of the writing instruments described herein. For example, the description provided above for the writing instrument 100 may be incorporated herein for writing instrument 600. Additional, different, or fewer components may be provided.

The focus tool 620 may include a track 630 and ball 640. The track 630 may include one or more shafts that allow the user to interact with the ball 640. In other embodiments, the track 630 may be enclosed so that the ball can roll back and forth completely enclosed. The ball 640 may roll up and down (e.g., shown with the dotted arrow line) inside of the track 630. As such, the user can attempt to balance the ball 640 at a certain location or get the ball as close to the edges without touching the edges and so on. It has been shown that challenging gravity can create the embodied cognitive activity that helps with improved activity in the ADD/ADHD brain. An example is when a child, or adult, tries to balance in a chair while leaning back with only two of the chair legs touching the ground. The gravitational pull on the ball will create a similar stimulation. In some embodiments, the edges 650 of the track 630 may include rubber caps that allow the ball 640 to bounce off the edges 650 without making noise or minimal noise.

Figure 7A:
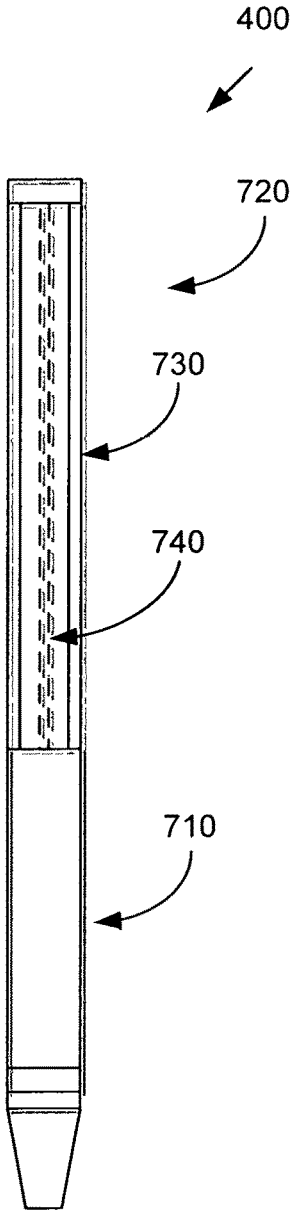
FIGS. 7A and 7B illustrate an exemplary embodiment of a rubber band and track focus tool.
Figure 7B:
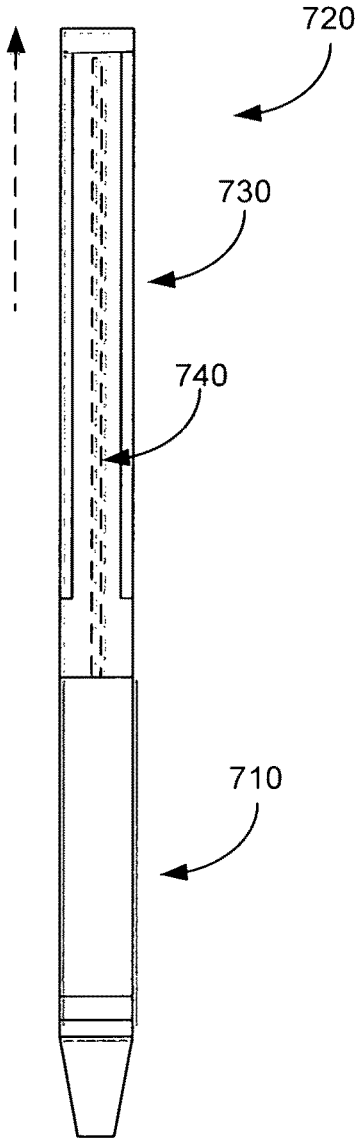

FIGS. 7A and 7B illustrates an example embodiment of a writing instrument 700 including a writing instrument base 710 and focus tool 620. The writing instrument 700 may be the same and/or similar to any of the writing instruments described herein. For example, the description provided above for the writing instrument 100 may be incorporated herein for writing instrument 700. Additional, different, or fewer components may be provided.

The focus tool 720 may include a track 730 and rubber band 740. One end of the rubber band 740 may be connected to the focus tool and the other end may be connected to the track 730. During operation, the user may pull the track 730 upward (e.g., shown by the dotted arrow) away from the end of the focus tool 720 connected to the rubber band 730. The elasticity of the rubber band will pull the track 730 back toward the focus tool 720. The muscle tension needed to pull the rubber band coupled with the back and forth movement of the track will stimulate a secondary sense, which in turn will help the user focus on the desired primary sense/activity.

Figure 8:
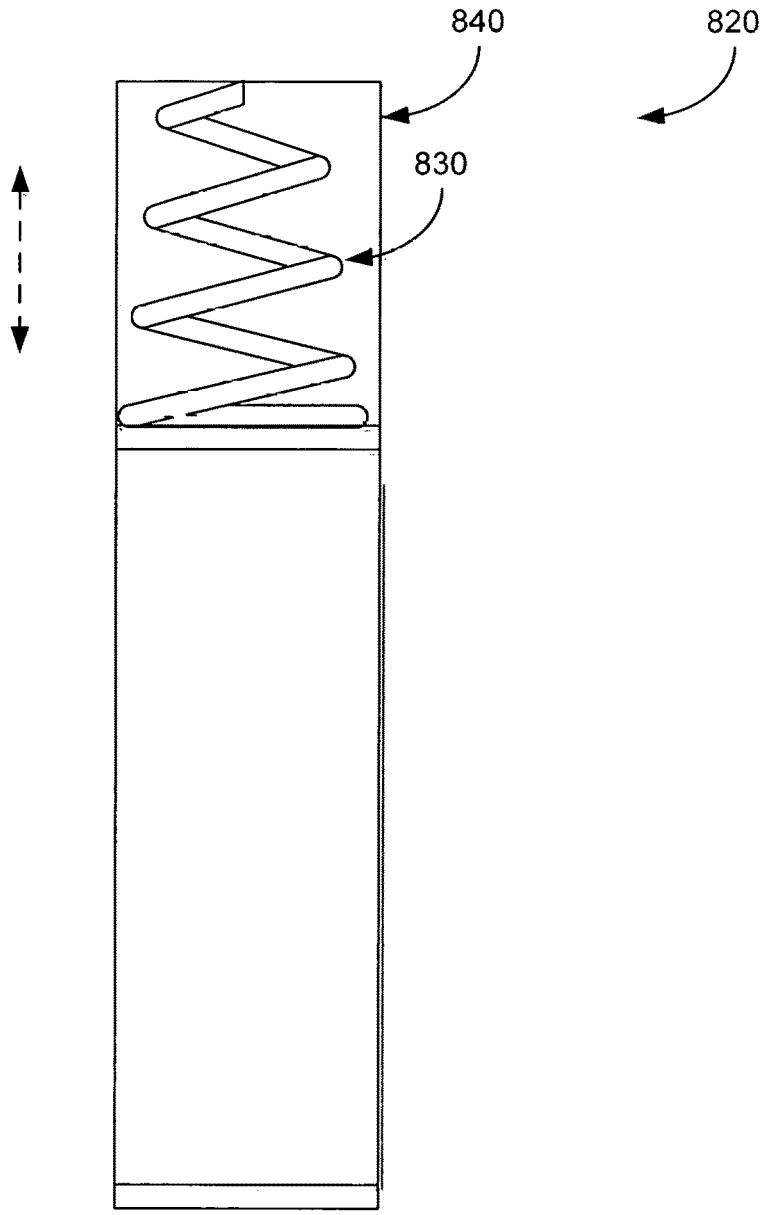
FIG. 8 illustrates an exemplary embodiment of a resistant spring focus tool.

FIG. 8 illustrates an example embodiment of a focus tool 820. The focus tool 820 may be the same and/or similar to any of the focus tools described herein. For example, the description provided above for the various focus tools may be incorporated herein for focus tool 820. Additional, different, or fewer components may be provided.

The focus tool 820 may include spring 830 inside a cap 840. The user may push the cap down (shown by the down arrow of the dotted line) against the resistance of the spring 830. The spring will return the cap to the original position when force is removed (shown by the up arrow of the dotted line). There is no clicking noise when pushing the cap or returning to the original position. A traditional spring-loaded pen is a familiar makeshift fidget device for those with ADD/ADHD. The resistant spring focus tool 830 facilitates that effective sensory-motor movement without the distracting clicking noise of the traditional pen, and in addition, it provides a completely discreet design so others are unaware of the fidget device.

Figure 9:
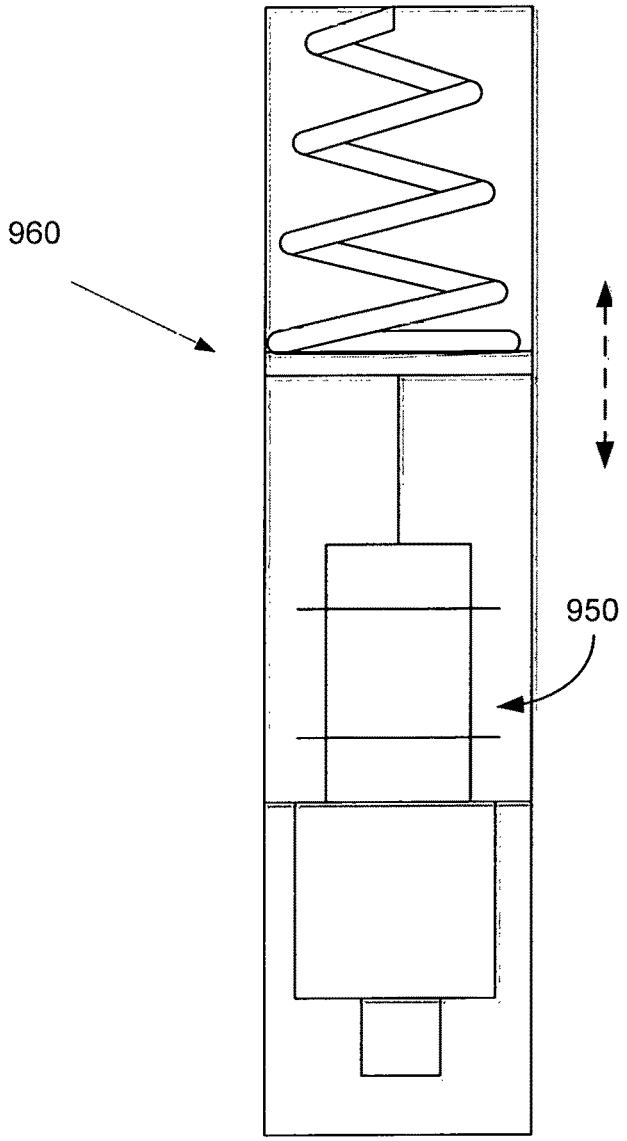
FIG. 9 illustrates an exemplary embodiment of a resistant spring focus tool with motorized resistance levels.

FIG. 9 illustrates an example embodiment of the focus tool 820 of FIG. 8, except the resistance of the spring 830 may be varied. For example, the focus tool 820 may include a platform 960 coupled with a motor 950. The motor 950 may move the platform up and down (shown by the dotted line with arrows). This movement may compress or decompress the spring 830, which changes the resistance of the spring 830.

iii. Exemplary Embodiments of Discreetness

In some embodiments, the focus tool may be discreet from other users. For example, the focus tool may be hidden or not viewable when not in use. Accordingly, when the writing instrument is not being used, others would not even know it includes a focus tool for wiggling or fidgeting. In another example, the focus tool may be hidden or not viewable even when in use. For example, the focus tool may be completely enclosed (e.g., sand inside a barrel). Accordingly, even when the writing instrument is being used (e.g., to fidget and/or to write), others will not even know it includes a focus tool for wiggling or fidgeting.

Figure 10A:
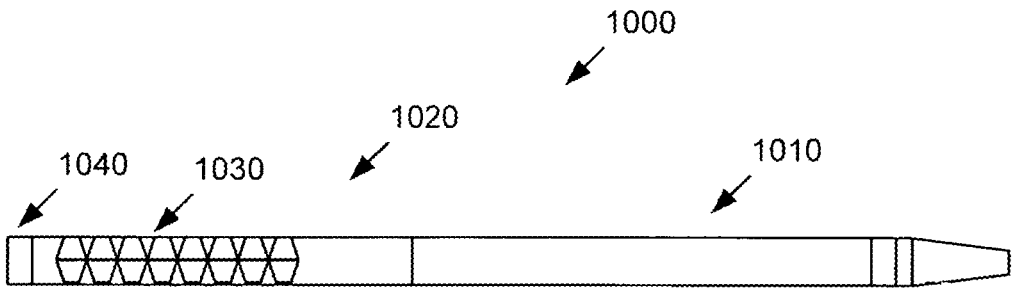
FIGS. 10A and 10B illustrate an exemplary embodiment of an open/close device that houses the fidget device completely inside the focus tool.
Figure 10B:
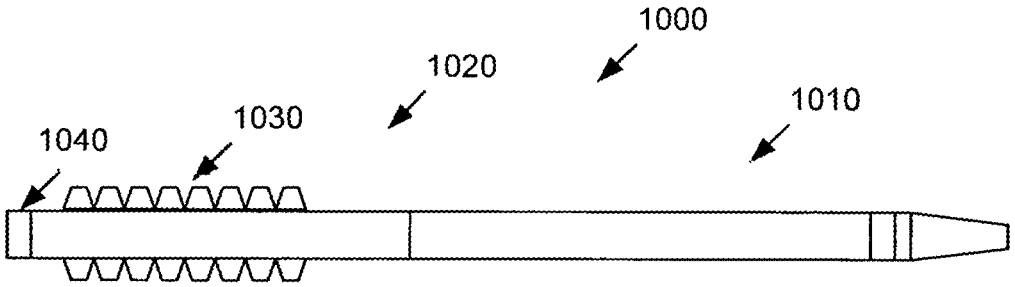

FIGS. 10A and 10B illustrate an exemplary embodiment of a writing instrument 1000 that includes a focus tool that may be moved inside the focus tool (e.g., when not being used to fidget) and then back outside focus tool (e.g., when needed for fidgeting). FIGS. 10A and 10B illustrates an example embodiment of a writing instrument 1000 including a writing instrument base 1010 and focus tool 1020. The writing instrument 1000 may be the same and/or similar to any of the writing instruments described herein. For example, the description provided above for the writing instrument 100 may be incorporated herein for writing instrument 1000. Additional, different, or fewer components may be provided.

The focus tool 1020 may include movable ridges 1030 coupled with an open/close device 1040. The movable ridges 1030 may be moved inside the focus tool 1020 (FIG. 10A) and then back outside the focus tool 1020 (FIG. 10B) by operating the open/close device 1040. In an embodiment, the open/close device 1040 may include a rod coupled with the movable ridges. The user may pull the rod out of the focus tool 1030 to have the ridges 1030 protrude from the focus tool 1020, as shown in FIG. 10B. Then, the user may push the rod back in to have the ridges 1030 recessed, as shown in FIG. 10A.

Figure 11:
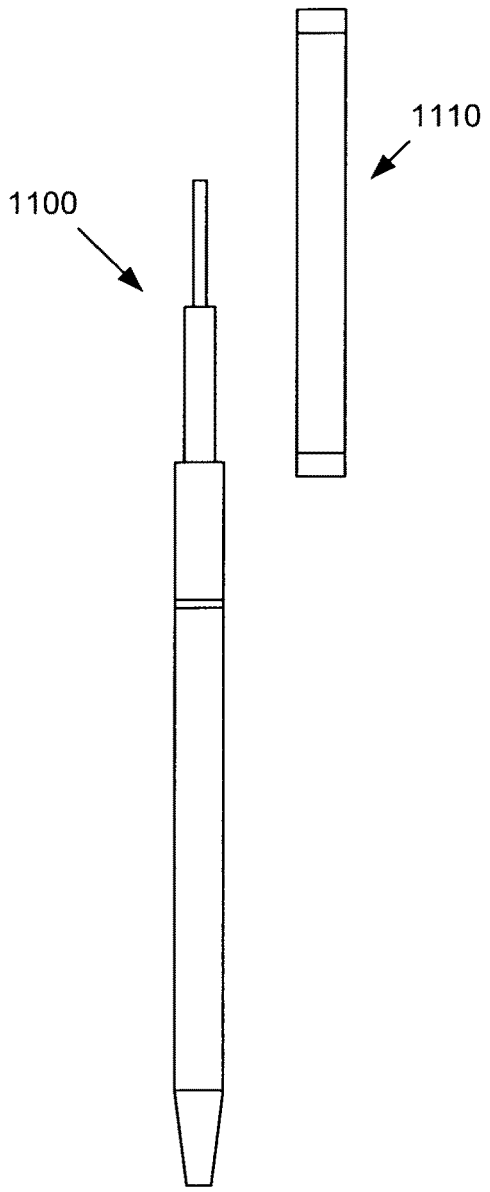
FIG. 11 illustrates an exemplary embodiment of a discreet cap covering the fidget tool.

FIG. 11 illustrates an exemplary embodiment of a writing instrument including a focus tool 1100. The writing instrument may include a cap 1110 that may be placed over the focus tool 1100 such that the focus tool 1100 is covered. The cap 1110 may be removed from the writing instrument.

Figure 12A:
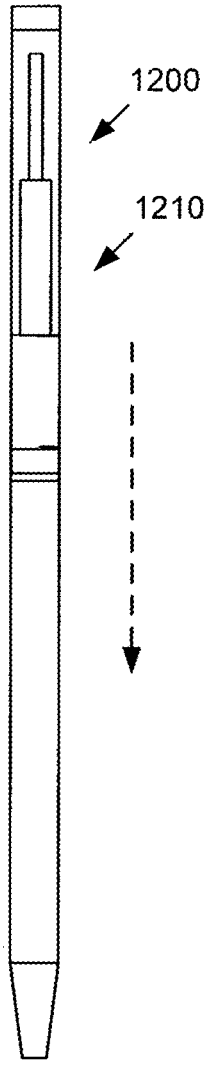
FIGS. 12A and 12B illustrate an exemplary embodiment of a discreet cap covering the fidget tool.
Figure 12B:
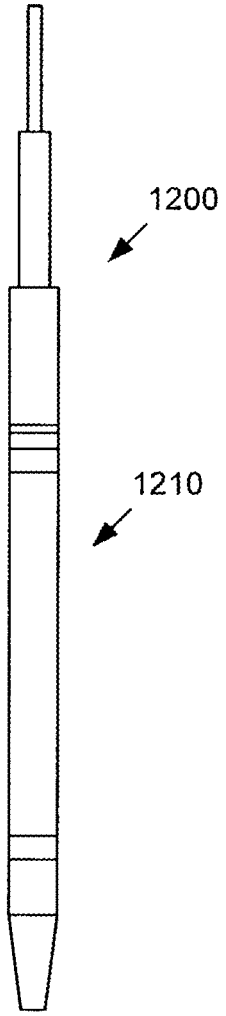

FIGS. 12A and 12B illustrates an exemplary embodiment of a writing instrument including a focus tool 1200. The writing instrument may include a sleeve 1110 that may slide over the focus tool 1100 such that the focus tool 1100 is covered. The sleeve 1210 may not be removed from the writing instrument. Instead, it slides up and down (shown by the dotted line) the writing instrument.

Figure 13:
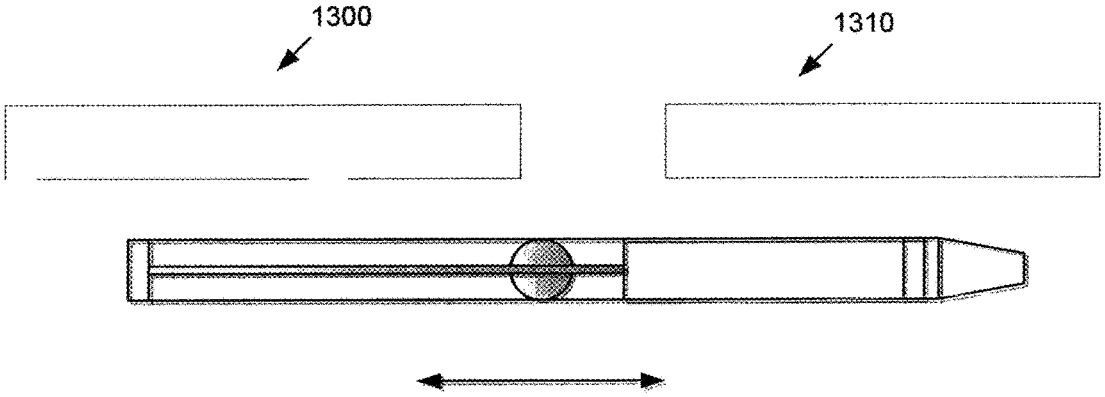
FIG. 13 illustrates an exemplary embodiment of a discreet sleeve covering the fidget tool.

FIG. 13 illustrates an exemplary embodiment of a writing instrument including a focus tool 1100. The writing instrument may include a cap 1110 that may be placed over the focus tool 1100 such that the focus tool 1100 is covered. The cap 1110 may be removed from the writing instrument.

iv. Example of Switching Focus Tools

Figure 14:
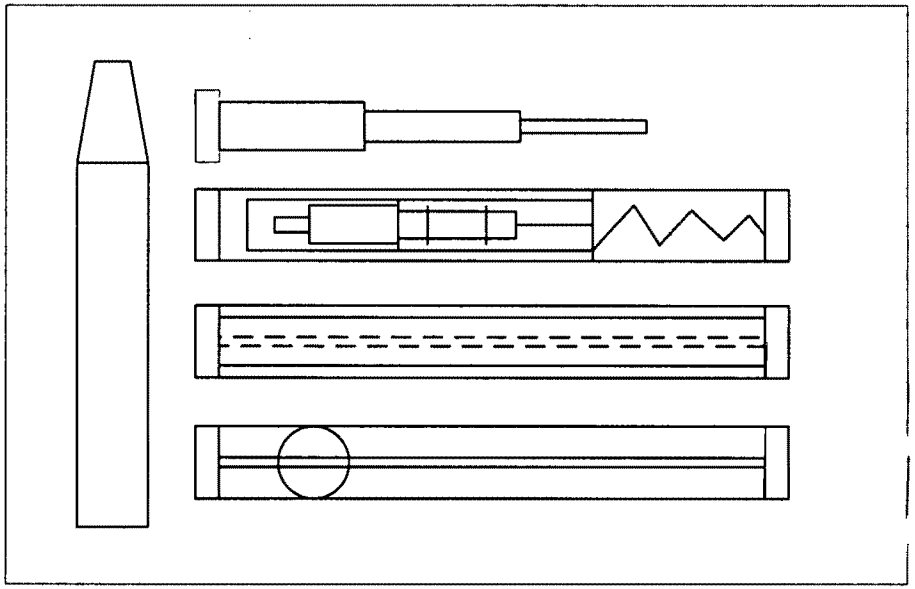
FIG. 14 illustrates an exemplary embodiment of a writing instrument including a writing instrument base with multiple focus tools.
Figure 15:
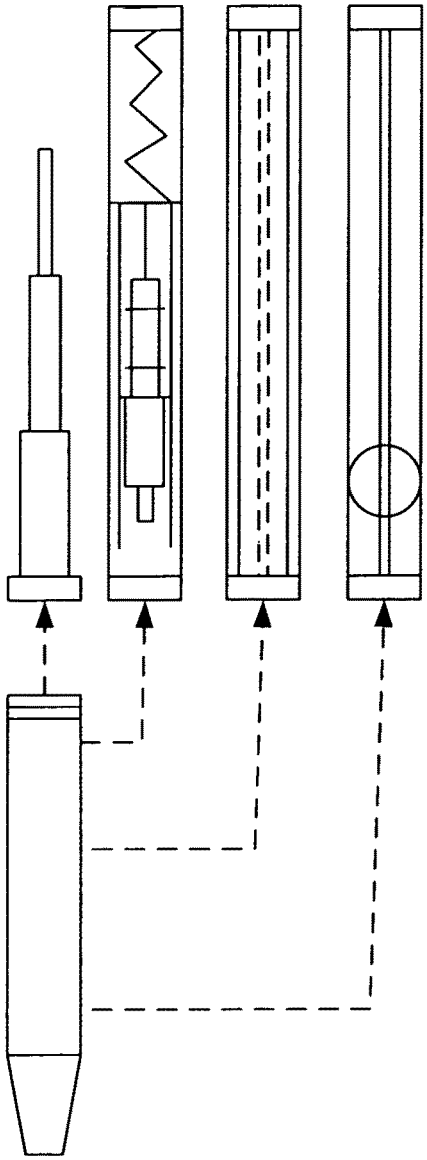
FIG. 15 illustrates an exemplary embodiment of a writing instrument including a writing instrument base with multiple focus tools.

FIGS. 14 and 15 illustrate an exemplary embodiment showing the sale of a writing instrument including a writing instrument base 1410 with multiple focus tools 1420. As shown by the dotted lines in FIG. 15, the writing instrument base 1410 may be connected and disconnected from each of the multiple focus tools 1420. This allows the writing instrument base 1410 to be used with various focus tools, such that the user does not become accustomed to a particular fidget.

The invention claimed is:

1. A writing instrument that comprises:

a writing instrument base that includes a marking system coupled with a barrel, wherein the marking system is configured to provide writings on a writing medium;

a first focus tool that is configured to be coupled with the writing instrument base, where the first focus tool is configured to blend in with the writing base wherein the first focus tool includes a first fidget device that engages a user's senses and reduces negative impact of attention deficit disorders when used by the user; and a second focus tool that is configured to be coupled with the writing instrument base, where the second focus tool is configured to blend in with the writing base wherein the second focus tool includes a second fidget device, which is different than the first fidget device, that engages a user's senses and reduces negative impact of attention deficit disorders when used by the user, wherein the writing instrument base is configured to allow the user to switch back and forth between the first focus tool and the second focus tool being coupled to the writing instrument base such that the user may choose which of the first or second focus tool is coupled to the writing instrument base.

2. The writing instrument of claim 1, wherein the first or second focus tool is embedded in the barrel.

3. The writing instrument of claim 1, wherein the first and second fidget devices include a texture that engages the user's senses.

4. The writing instrument of claim 1, wherein the first fidget device includes resistance that engages the user's senses.

5. The writing instrument of claim 1, wherein the first fidget device includes pliable material that engages the user's senses.

6. The writing instrument of claim 1, wherein the first fidget device includes chewable material that engages the user's senses.

7. The writing instrument of claim 1, wherein the first fidget device includes texture that engages the user's senses.

8. The writing instrument of claim 1, wherein the first fidget device stimulate the user's vestibular system and proprioceptive senses through one or more of the following: movement, sound, smell, visual and tactile action.

9. The writing instrument of claim 1, wherein the first and second fidget devices are discreet.

10. The writing instrument of claim 9, wherein the first and second fidget devices are hidden or not viewable when not in use.

11. The writing instrument of claim 10, wherein the first fidget device may be hidden or not viewable even when in use, such that even when the writing instrument is being used, it is not noticeable that the writing instrument includes a focus tool.

12. The writing instrument of claim 9, wherein the first focus tool may be both moved inside the focus tool and then back outside the focus tool.

* * * * *